US007357569B2

(12) United States Patent
Yoshikawa

(10) Patent No.: US 7,357,569 B2
(45) Date of Patent: Apr. 15, 2008

(54) CROWN LOCK STRUCTURE AND TIMEPIECE HAVING CROWN LOCK STRUCTURE

(75) Inventor: Hisamitsu Yoshikawa, Chiba (JP)

(73) Assignee: Seiko Instruments Inc. (JP)

( * ) Notice: Subject to any disclaimer, the term of this patent is extended or adjusted under 35 U.S.C. 154(b) by 262 days.

(21) Appl. No.: 10/793,285

(22) Filed: Mar. 4, 2004

(65) Prior Publication Data

US 2004/0257917 A1 Dec. 23, 2004

(30) Foreign Application Priority Data

Mar. 10, 2003 (JP) ..... 2003-063252

(51) Int. Cl.
*G04B 3/00* (2006.01)

(52) U.S. Cl. ..... 368/308; 368/319; 368/216

(58) Field of Classification Search ..... 368/206, 368/216, 288–291, 308, 319
See application file for complete search history.

(56) References Cited

U.S. PATENT DOCUMENTS 1,295,023 A * 2/1919 Golden ..... 368/289
1,505,521 A * 8/1924 Kresser ..... 368/232
2,309,428 A * 1/1943 Aegler ..... 368/288
2,482,317 A * 9/1949 Borer ..... 368/288
3,362,154 A * 1/1968 Perret ..... 368/290
3,535,869 A * 10/1970 Strigini et al. ..... 368/289
4,313,187 A * 1/1982 Waki et al. ..... 368/319
5,257,247 A * 10/1993 Miche et al. ..... 368/290
5,598,383 A * 1/1997 Li ..... 368/291
6,872,899 B2 * 3/2005 Oshio et al. ..... 200/43.13
6,886,975 B2 * 5/2005 Hiranuma et al. ..... 368/289

FOREIGN PATENT DOCUMENTS

JP 57046181 3/1982

* cited by examiner

*Primary Examiner*—P. Austin Bradley
*Assistant Examiner*—Jeanne-Marguerite Goodwin
(74) *Attorney, Agent, or Firm*—Adams & Wilks

(57) ABSTRACT

A crown lock structure for a timepiece has a crown having an inner surface provided with a threaded section and a connecting assembly for removably connecting the crown to a case of the timepiece. The connecting assembly comprises a tubular member for integral connection to the timepiece case and a tubular insert removably connected to the tubular member. The tubular member has a first tubular portion for insertion into a through-hole of the timepiece case and a second tubular portion integral with the first tubular portion and removably connected to the tubular insert so as to prevent relative rotation between the tubular member and the tubular insert. The tubular insert has a threaded section for threaded engagement with the threaded section of the crown to removably connect the crown to the timepiece case.

12 Claims, 5 Drawing Sheets

CROWN LOCK STRUCTURE AND TIMEPIECE HAVING CROWN LOCK STRUCTURE

BACKGROUND OF THE INVENTION

1. Field of the Invention

The present invention relates generally to timepieces and, more specifically, to a crown structure for a timepiece, such as a portable watch, which prevents the crown from being accidentally rotated.

2. Description of the Prior Art

In a portable watch exemplified by a divers watch, adopted is the structure in which a crown is locked utilizing a screw engagement (such a structure is referred to as a screw lock in this specification) to prevent the crown from accidentally rotating when the portable watch is carried around.

The screw lock structure is the structure in which a case including a watch movement is attached with a winding stem pipe, and to a male screw section formed to the outer rim of an extracase end section of the pipe, a female screw section locating at a crown main section to be fit to the extracase end section is screwed. With such a structure, under normal circumstances, the crown main section is screwed into the outer rim of the extracase end section so that the crown is locked. In order to operate the watch movement, the crown main section is unscrewed from the male screw section, and after pulling out the crown, a winding stem locating inside of the winding stem pipe can be operated for rotation.

With the conventional portable watch of such a screw lock structure, generally, a winding-stem-pipe-attachment section can be made waterproof by brazing the winding stem pipe to the case (see JP-A-57-4681 (from 8th line, right column, page 1 to 7th line, left column, page 2, FIGS. 1 and 2) as an example).

Other than the above, also known is another portable watch of a type aiming for waterproof capability of the winding-stem-pipe-attachment section. Therein, in the middle part of the winding stem pipe in the axial direction, a male screw section is provided separately from another male screw section to which a crown is screwed together so that the male screw section is screwed into the pipe-attachment hole of the case, and after this screwing is completed, a waterproof gasket is sandwiched between the case and the winding stem pipe.

In a portable watch with the screw lock structure, repeatedly operating the crown for rotation will cause both the screwed-together female screw section of the crown and the male screw section of the winding stem pipe to be worn out or chipped, resultantly reducing the screw lock capability.

In such a case, the portable watch of JP-A-57-46181 in which the case is brazed with the winding stem pipe does not allow exchange of components locating close to the crown if requiring removal of the winding stem pipe from the case. There is thus no choice to exchange the watch exterior assembly including the case. As such, there has been a demand for improvement thereof.

With a watch having a winding stem pipe screwed into a case, it has been considered that, in principle, exchange is possible for components including the winding stem pipe, locating close to the crown. Even with such a structure, however, the winding stem pipe receives rotation forces every time the crown is screwed into the winding stem pipe or every time this screwing is unscrewed. Accordingly, the screwing of the winding stem pipe into the case becomes loose, resultantly possibly causing the waterproof capability achieved by a waterproof gasket to be reduced.

As measures against that, adhesive filling is sometimes done to the section at where the winding stem pipe and the case are screwed together. If adhesive is used for attachment as such, the winding stem pipe becomes difficult to be removed from the case, and in practical sense, exchange of components locating close to the crown becomes impossible. As a result, there has been no choice to exchange the watch exterior assembly including the case if the screw lock capability is reduced. As such, there has been a demand for improvement thereof.

An object to be achieved by the present invention is to provide a portable watch capable of exchange of components locating close to the crown when the screw lock capability is reduced.

SUMMARY OF THE INVENTION

In order to achieve the above object, the present invention is characterized in that a winding stem pipe fixed to a case for screw locking a crown is provided with: a winding stem pipe body inserted into a pipe-attachment hole of the case to be fixed to the case to be watertight; and an exterior pipe whose outer rim plane is formed with a male screw section to be screwed together with a female screw section of the crown in a removable manner, and to the outer rim of an extracase end section of the winding stem pipe body to be arranged outside of the case, the exterior pipe is prevented from rotating and fit thereto in a removable manner.

In the present invention, the winding stem pipe is fixed to the case not to be separated therefrom. On the other hand, the exterior pipe screwed together with the female screw section of the crown for screw locking the crown is removable from the extracase end section of the winding stem pipe body. With such a structure, if the screw lock capability is reduced responding to the crown operation for exerting or releasing the screw lock capability, the crown and the exterior pipe can be separately exchanged with the winding stem pipe body fixed to the case. In a preferred embodiment of the present invention, each of the winding stem pipe body and the exterior pipe is made of a different material. Thus, it is considered superior in the respect that the design flexibility can be improved by allowing the winding stem pipe body and the exterior pipe to be made of any appropriate material corresponding to their own capabilities.

In the preferred embodiment of the present invention, the exterior pipe is made of a material better in abrasion resistance than that of the winding stem pipe body. Accordingly, with no limitation on the material of the winding stem pipe body, it is considered superior in that the screw lock structure can be improved in durability.

BRIEF DESCRIPTION OF THE DRAWINGS

A preferred form of the present invention is illustrated in the accompanying drawings in which.

DETAILED DESCRIPTION OF THE PREFERRED EMBODIMENTS

In the following description, an embodiment of the present invention will be described with reference to FIGS. 1 to 5.

Figure 1:
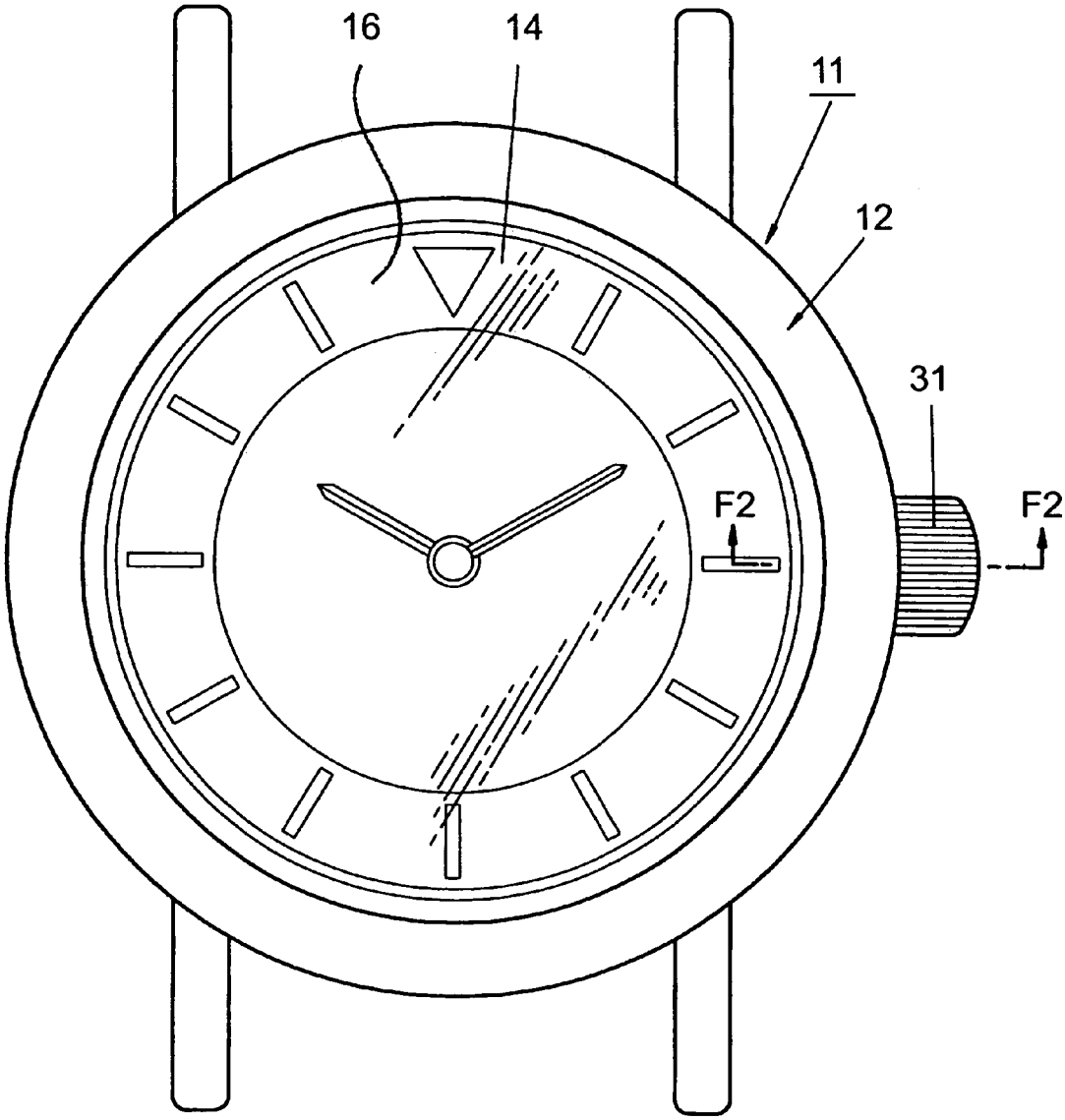
FIG. 1 is a front view of a divers watch according to an embodiment of the present invention.

A reference numeral 11 in FIG. 1 shows a divers watch as a portable watch equipped with the screw lock structure for a crown. This watch 11 accommodates a watch movement, and the like, that is not shown in a watch exterior assembly 12. The type of watch movement is not restrictive, and may be of a type whose power source is a small-sized battery or a spring, a self-winding type, of a type equipped for a digital watch displaying time or other information in digital form on a dial using a quartz oscillator module, or a type which combines a digital watch with one or more other types of watch movements.

The watch exterior assembly 12 is so formed that a cover glass 14 is attached to be watertight over the surface of an annular metallic case 13 in the thickness direction, and a case back 15 (refer to FIG. 2) made of metal, and the like, is attached to be watertight over the back plane of the case 13. A dial 16 and other components can be seen through the cover glass 14, and the case back 15 can be removable.

Figure 2:
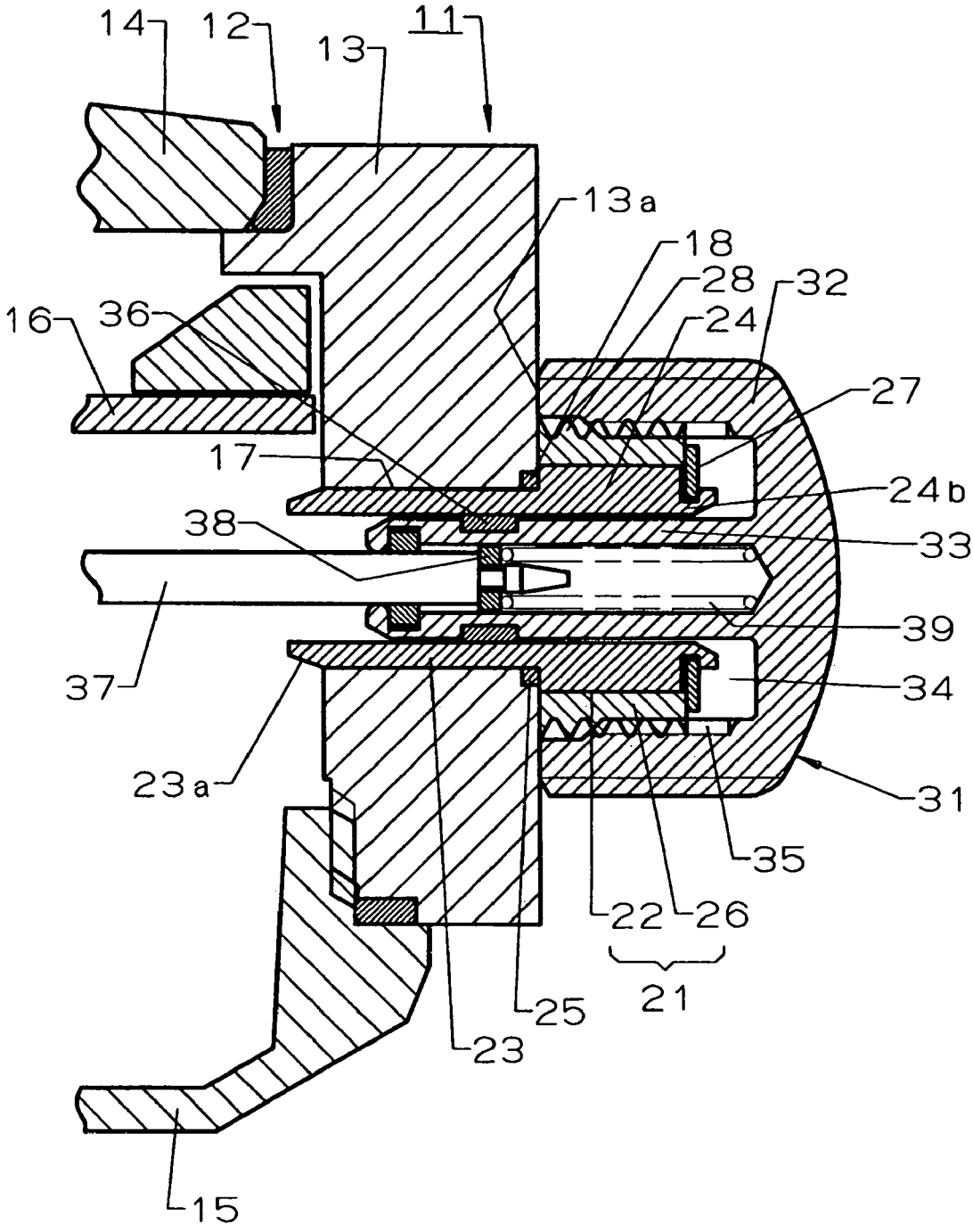
FIG. 2 is a cross-sectional view cut along an F2-F2 line in FIG. 1 with a crown screw locked.

As shown in FIG. 2, the case 13 has, at a part thereof, a through-hole in the form of a pipe-attachment hole 17 going through the case 13 in the radius direction. One end of the pipe-attachment hole 17 opens to an interior surface of the case 13 at an intracase side, that is, to inside of the watch exterior assembly 12. The other end of the pipe-attachment hole 17 opens to an exterior surface 13*a* of the case 13 at an extracase side, that is, to outside of the watch exterior assembly 12. The exterior surface or extracase plane 13*a* of the case 13 includes an accommodation groove 18. This accommodation groove 18 is made larger in diameter than the pipe-attachment hole 17, and goes through the opening made on the extracase side of the hole 17 and is provided concentrically with the opening. 18 is made larger in diameter than the pipe-attachment hole 17, and goes through the opening made on the extracase side of the hole 17 and is provided concentrically with the opening.

To the case 13, a connecting assembly comprised of a winding stem pipe 21 is fixed from the extracase side to be watertight by extending through the pipe-attachment hole 17.

Figure 4:
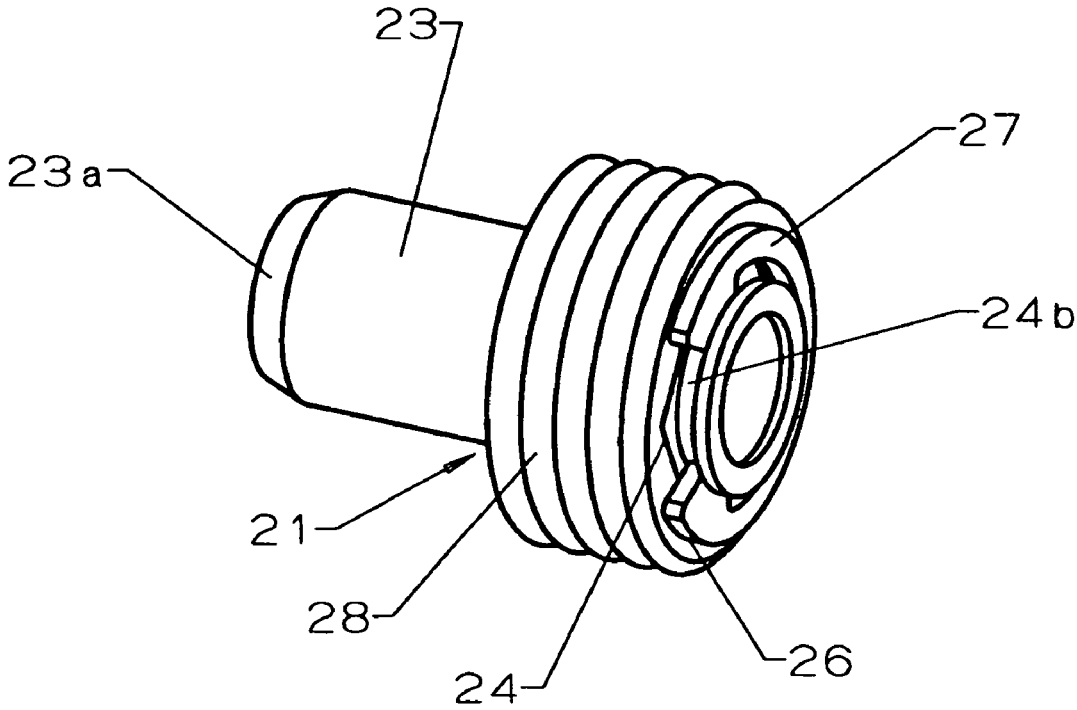
FIG. 4 is a perspective view of a winding stem pipe of the divers watch of FIG. 1.
Figure 5:
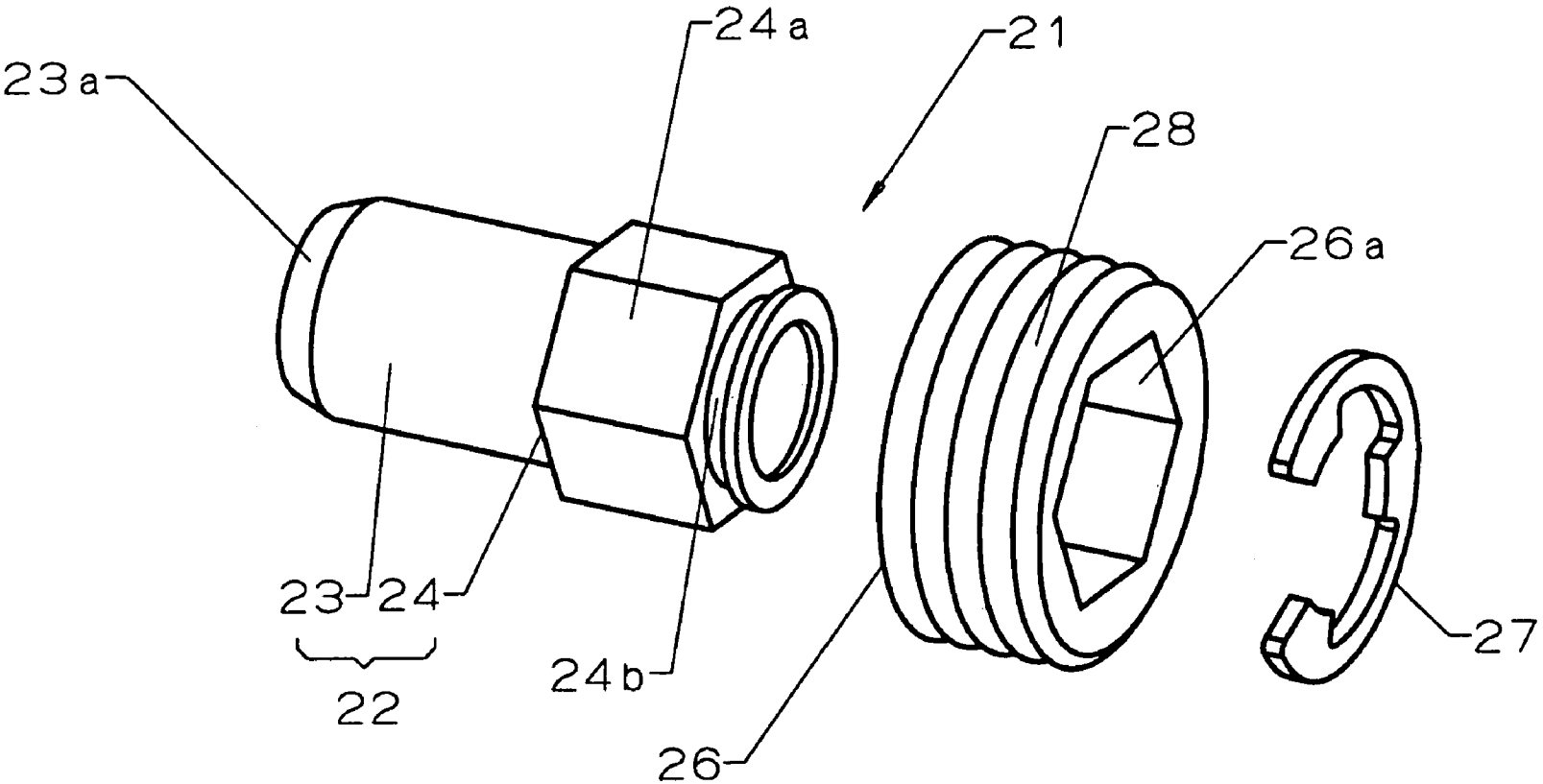
FIG. 5 is an exploded perspective view of a winding stem pipe of FIG. 4.

In detail, as shown in FIGS. 2, 4, and 5, the winding stem pipe 21 is comprised of a tubular member defining a winding stem pipe body 22 and a tubular insert comprising an exterior pipe 26 slidably inserted over the winding stem pipe body 22.

The winding stem pipe body 22 is made of metal, and a preferable exemplary usage option therefor is stainless steel. This winding stem pipe body 22 is provided with an inner insertion section 23 at one end thereof, and an outer or extracase end section 24 at the other end thereof. The insertion section 23 is the part to be inserted into the pipe-attachment hole 17 with a, press-fit from the extracase side, and at the outer rim of the tip part thereof, a taper plane 23*a* in tapered form is provided. The outer or extracase end section 24 is the part to be arranged outside of the case 13, and is made to be square- or hexagon-shaped, for example. The diameter of this extracase end section 24 is larger than the outer diameter of the insertion section 23 and the diameter of the accommodation groove 18. To the end part locating opposite to the side abutting to the extracase plane 13*a* of the extracase end section 24, a stopper-attachment section, for example, an annular groove 24*b* as shown in FIG. 5 is formed.

The winding stem body 22 is inserted into the pipe-attachment hole 17 until the extracase end section 24 abuts the extracase plane 13*a*. At the same time, it is fixed to the case 13 not to be separated therefrom by a metallic brazing material 25 filled to the accommodation groove 18. The brazing material 25 used for fixation functions also to provide a waterproof seal between the case 13 and the winding stem pipe body 22.

In the present embodiment, although the insertion section 23 extends through the pipe-attachment hole 17, it may have a length so as to not extend through the attachment hole 17. Further, as to the insertion section 23, the major diameter thereof may be the base side part closer to the extracase end section than the tip side part thereof, and corresponding thereto, the accommodation groove 18 may be so formed as to be deep enough to accept the base part, and the brazing material 25 is filled into between the step height part formed by the tip side part and the base part and the further set part of the accommodation groove 18 for fixing the winding stem pipe body 22 to the pipe-attachment hole 17 to be watertight. Alternatively, instead of the brazing, to achieve watertight fixation, a rubber waterproof gasket may be sandwiched between the case 13 and the winding stem pipe body 22 to screw the insertion section 23 into the pipe-attachment hole 17, and the pipe-attachment hole 17 and the insertion section 23 may be attached together using an adhesive.

As shown in FIG. 5, inner rim planes or flat sections 26*a* of the exterior pipe 26 define a hole corresponding to the shape of complementary outer rim planes or flat sections 24*a* of the extracase end section 24. This exterior pipe 26 is fit to the extracase end section 24 in a removable manner. The inner rim planes or flat sections 26*a* of the exterior pipe 26 and the complementary outer rim planes or flat sections 24*a* of the extracase end section 24 are configured to abut each other. With such a structure, the exterior pipe 26 is prevented from rotating in the circumferential direction with respect to the extracase end section 24.

Therefore, the outer rim planes 24*a* of the extracase end section 24 and the inner rim planes 26*a* of of the exterior pipe 26 form polygon shapes and define rotation-stop means for the exterior pipe 26. It is understood, however, that the structure of the rotation-stop means is not limited to the foregoing structure. For example, the rotation-stop means can be structured by, for example, one or more keys extending in the axial direction of the pipe and a key groove(s) to be fit thereinto to freely swing, or may be structured by achieving fixation utilizing serration.

Figure 3:
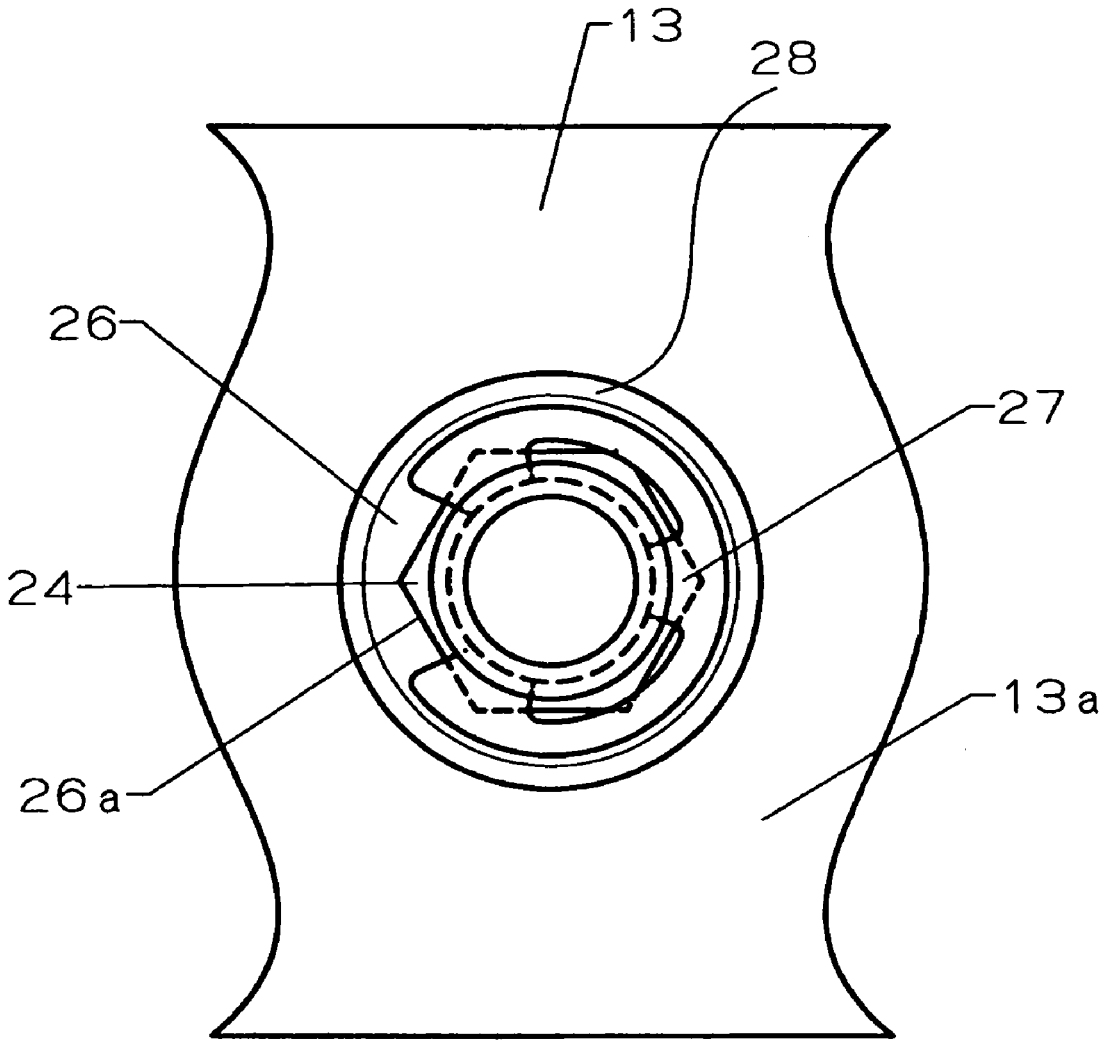
FIG. 3 is a front view of a winding-stem-pipe-attachment section with the crown of the divers watch of FIG. 1 removed.

To the annular groove 24*b* of the extracase end section 24, for example, a stopper member comprised of an E-shaped stopper 27 shown in FIGS. 2 to 4 is attached. In the present embodiment, the annular groove 24*b* protrudes to the side outer than the end plane of the exterior pipe 26 when the exterior pipe 26 is fit into the extracase end section 24. And the end plane of the exterior pipe 26 is formed to such a position as to be pressed by the stopper 27. The stopper 27 can be attached or removed to/from the annular groove 24*b* by changing in shape due to its elasticity using a tool, which is not shown. The outer diameter of this stopper 27 is made smaller than the trough diameter of a threaded or a male screw section 28, which will be described later, to avoid any interference with a female screw section 35 of the crown, which will be described later. The stopper 27 is used as stopper means for pressing the end plane of the exterior pipe 26, and for preventing the exterior pipe 26 from being disengaged in the axial direction with respect to the extracase end section 24. Here, this not restrictive, and a possible option for the stopper means may be a board nut for pressing the end plane of the exterior pipe 26 by being screwed together in a removable manner with a screw section provided to the part out of the region of the extracase end section 24 to which the exterior pipe 26 is fitted, for example.

As described in the foregoing, to the outer rim plane of the exterior pipe 26, which is fit in a removable manner to the outer rim of the extracase end section 24 for preventing rotation, there is provided the male screw section 28 for screw locking.

The exterior pipe 26 is made of the same material as for the winding stem pipe body 22 or from different material. When the exterior pipe 26 is made of the same material (e.g., stainless steel) as that of the winding stem pipe body 22, it is considered superior in the respect that no electrical rust occurs as in the case where metals of different types abut one another. When the exterior pipe 26 is made of a different material from that of the winding stem pipe body 22, the winding stem pipe body 22 and the exterior pipe 26 can be made of any appropriate material corresponding to their own capabilities. As such, it is considered superior in the respect that the design flexibility can be improved. What is more, if any different material is used, the exterior pipe 26 may be made of a material better in abrasion resistance than the winding stem pipe body 22 without being restricted by the material of the winding stem pipe body 22. As such, there is no need to make the winding stem pipe 21 in its entirety with any material between in abrasion resistance, and thus it is considered superior in the respect that the screw lock structure durability can be improved with low cost.

The winding stem pipe 21 structured as above is attached to the case 13 by, as described in the foregoing, inserting the insertion section 23 of the winding stem pipe body 22 into the pipe-attachment hole 17 of the case 13 for brazing with the extracase end section 24 of the winding stem pipe body 22 attached in advance with the exterior pipe 26 and the stopper 27 as shown in FIG. 4. Alternatively, attachment to the case 13 can be done by inserting only the winging stem pipe body 22 to the pipe-attachment hole 17 of the case 13 for brazing, the exterior pipe 26 is fitted to the extracase end section 24 arranged outside of the case 13, and then the annular groove 24*b* is attached with the stopper 27.

A crown denoted by a reference numeral 31 in FIG. 1 is made of metal, and as shown in FIG. 2, is provided with a crown main section 32 and a crown tube section 33 extending in its entirety in the axial direction from the middle section thereof. To the crown main section 32, an annular clearance groove 34 is provided to enclose the base section of the crown tube section 33. A threaded or female screw section 35 is formed to the inner rim plane of the groove 34 for screw locking. The clearance groove 34 is a part into which the extracase end section 24 and the exterior pipe 26 of the winding stem pipe 21 are inserted. The female screw section 35 is screwed together with the male screw section 28 of the exterior pipe 26 in a removable manner. Through such screwing, provided is the capability for the screw lock not to allow the crown 31 to accidentally rotate when the watch 11 is carried around.

The crown tube section 33 is inserted into the winding stem pipe 21 from the extracase side. To an annular gasket attachment groove formed to the outer rim of the tube section 33, a waterproof member comprised of an annular waterproof rubber gasket 36 is attached. The waterproof gasket 36 is sandwiched between the inner rim plane of the winding stem pipe 21 and the outer rim plane of the crown tube section 33 by changing in shape due to its elasticity through compression, for the purpose of achieving waterproof therebetween. The crown tube section 33 receives a winding stem 37 of the watch movement from the interacase side, and accommodates a coil spring 39 for biasing the winding stem 37 in the axial direction via a spring bearing 38. The watch movement rotates in relation with the rotation operation of the crown 31 with the female screw section 35 being disengaged from the second male screw section 28, in other words, with the screw lock released. In such a manner, time adjustment and other functions are carried out.

Herein, as to the crown 31, the crown tube section 33 thereof is inserted into the winding stem pipe 21 from the extracase side with the winding stem 37 connected thereto, and the female screw section 35 of the crown main section 32 is screwed and clamped with the male screw section 28 of the exterior pipe 26. In this manner, attachment is done. When the crown 31 is screwed into the male screw section 28 to the furtherest point, the position of the crown main section 32 is defined when it abuts the extracase plane 13*a* of the case 13 as shown in FIG. 2 so that the extracase plane 13*a* of the case 13 as shown in FIG. 2 so that the exterior pipe 26 is entirely covered. Here, after such a procedure is complete, the winding stem 37 and the watch movement are connected together.

With such assembly completed, the waterproof capability can be exerted and retained under high pressure. That is, a waterproof seal between the winding stem pipe 21 and the case 13 can be secured thanks to the brazing material 25 used for their fixation, and a waterproof seal between the winding stem pipe 21 and the crown tube section 33 internally inserted thereinto can be secured thanks to the waterproof gasket 36 sandwiched therebetween by changing in shape due to its elasticity through compression.

In the divers watch 11 assembled as shown in FIG. 2, the crown 31 is engaged with the male screw section 28 of the winding stem pipe 21 for screw lock. This prevents the crown 31 from accidentally rotating when carried around, whereby time display and others do not change. For time adjustment, for example, the crown 31 is rotated in the reverse direction so as to disengage the crown main section 32 from the male screw section 28. Thus, for the purpose, the crown 31 is pulled out against the spring forces of the coil spring 39.

Responding to the operation of the crown 31, if the screw lock capability of the crown 31 is reduced due to damage or wear-out of the male screw section 28 and the female screw section 35 screwed thereinto, it can be dealt with as follows.

That is, the stopper 27 can be removed from the annular groove 24*b* of the extracase end section 24 of the winding stem pipe body 22, and through removal as such, the exterior pipe 26 having fitted to the extracase end section 24 becomes able to be removed from the extracase end section 24 by being pulled out along the axial direction of the winding stem pipe body 22 brazed to the case 13. Therefore, when the screw lock capability is reduced, the exterior pipe 26 including the male screw section 28 of the winding stem pipe 21 and the crown 31 attachable or removal thereto/therefrom can be separately exchanged.

Accordingly, during a repairing operation, there is no need to exchange the watch exterior assembly 12 including the case 13, and the like, even if the screw lock capability is reduced. Thus, only the damaged component needs to be exchanged, thereby favorably reducing costs.

As described in the foregoing, with the winding stem pipe body 22 fixed to the case 13, the exterior pipe 26 of the winding stem pipe 21 can be exchanged. For exchange, as exchange components, a plurality of types of exterior pipes having the same inner rim plane shape but varying in the diameter, pitch, the number of threads, and others of the male screw section 28 may be prepared in advance. Also, the crown 31 including the female screw section each corresponding to these male screw sections 28 may be prepared for a plurality of types. In such a case, exchange is not restrictive to those of the same type as the exterior pipe 26 and the crown 31 which is damaged and discarded after use. However, exchange to any new exterior pipe 26 and crown 31 of the same type arbitrarily selected among the plurality of types is possible. This eases component management for manufacturers because there is no more need to store the exchange components for a long period of time.

The present invention is not restricted to the above embodiment. For example, it can be applied to portable watches such as normal wrist watches or pocket watches that do not require waterproof capability under high pressure.

In the present invention, with respect to an extracase end section of a winding stem pipe body fixed to a case to be watertight not to be separated therefrom, an exterior pipe for screw locking a crown through screwing with a female screw section is prevented from rotation, thereby rendering it removable. Thus, according to the present invention, when the screw lock capability is reduced responding to the crown operation, provided is a portable watch capable of exchanging separately components around the crown, that is, the crown and the exterior pipe for screw locking it with the winding stem pipe body fixed to the case.

According to the present invention in which a winding stem pipe and an exterior pipe are each made of a different material, provided is a portable watch with which the design flexibility can be improved by allowing the winding stem pipe body and the exterior pipe to be made of any appropriate material corresponding to their own capabilities.

According to the present invention in which an exterior pipe is made of a material better in abrasion resistance than a winding stem pipe body, provided is a portable watch capable of improving the durability of the screw lock structure with no limitation on the material of the winding stem pipe body.

What is claimed is:

1. A portable watch comprising: a case having a pipe-attachment hole extending therethrough; a winding stem pipe comprised of a winding stem pipe body and an exterior pipe, the winding stem pipe body having an inner section inserted into the pipe-attachment hole and fixed to the case in a watertight manner and an outer section that extends out from the exterior of the case, the exterior pipe being removably slidably inserted over the outer section of the winding stem pipe body and having on its outer periphery a male screw section; means on the outer section of the winding stem pipe body cooperating with complementary means on the exterior pipe for preventing relative rotation between the winding stem pipe body and the exterior pipe; and a crown having a crown tube slidably extending into and rotatable in the winding stem pipe body and a female screw section removably screwed onto the male screw section to screw lock the crown against unintended rotation.

2. A portable watch according to claim 1; further including a stopper removably connected to the outer section of the winding stem pipe body and engaging with the exterior pipe to prevent relative axial movement between the winding stem pipe body and the exterior pipe.

3. A portable watch according to claim 2; wherein the stopper is removably mounted in an annular groove formed in the winding stem pipe body and abuts against an end face of the exterior pipe.

4. A portable watch according to claim 2; wherein the stopper abuts against an end face of the exterior pipe.

5. A portable watch according to claim 1; wherein the winding stem pipe body is fixed to the case by brazing material.

6. A portable watch according to claim 1; wherein the case has an annular groove that opens at the pipe-attachment hole; and a brazing material or an adhesive material disposed in the annular groove for fixing the winding stem pipe body to the case.

7. A portable watch according to claim 1; wherein the winding stem pipe body and the exterior pipe are each made of a different material.

8. A portable watch according to claim 7; wherein the exterior pipe is made of a material having a higher abrasion resistance than that of the winding stem pipe body.

9. A portable watch according to claim 1; wherein the exterior pipe is made of a material having a higher abrasion resistance than that of the winding stem pipe body.

10. A portable watch according to claim 1; wherein the means on the outer section of the winding stem pipe body comprises a noncircular outer peripheral portion of the outer section, and the complementary means on the exterior pipe comprises a noncircular inner peripheral portion of the exterior pipe engageable with the noncircular outer peripheral portion to prevent relative rotation between the winding stem pipe body and the exterior pipe.

11. A portable watch according to claim 10; wherein the noncircular inner and outer peripheral portions each have plural flat sections.

12. A portable watch according to claim 10; wherein the noncircular inner and outer peripheral portions have a polygon shape.

* * * * *